United States Patent [19]

Naes

[11] Patent Number: 5,017,093

[45] Date of Patent: May 21, 1991

[54] THERMOSTATICALLY CONTROLLED BOAT DE-ICER

[76] Inventor: Oscar L. Naes, 2043 Kehrs Mill Rd., Chesterfield, Mo. 63017

[21] Appl. No.: 437,841

[22] Filed: Nov. 17, 1989

[51] Int. Cl.[5] ..... F04B 49/00; F02B 3/12

[52] U.S. Cl. ..... 417/14; 405/61

[58] Field of Search ..... 405/61; 417/14, 32; 236/49.3

[56] References Cited

U.S. PATENT DOCUMENTS

| | | | |
|---|---|---|---|
| 2,991,622 | 7/1961 | Oster | 405/61 |
| 3,083,538 | 4/1963 | Gross | 405/61 |
| 3,486,081 | 12/1969 | Kanbar | 236/1 X |
| 3,785,165 | 1/1974 | Valenzuela, Jr. | 62/231 X |

*Primary Examiner*—William E. Wayner

*Attorney, Agent, or Firm*—Polster, Polster and Lucchesi

[57] ABSTRACT

A thermostat control for use in conjunction with a boat dock de-icer, wherein the thermostat control includes an electrical outlet, a plug for connecting the control to a source of electrical energy, a set point controller for controlling the operation of the thermostat, and a temperature sensor for sensing a fluid. A conventional boat dock de-icer is plugged into the thermostat control and the thermostat control is connected to a source of electrical energy. The temperature sensor is placed in water in the vicinity of a boat dock, and the set point is set to any desired temperature, but preferably to a temperature about freezing. When the control temperature of the water is reached, the thermostat control permits operation of the boat dock de-icer, so that the de-icer operates only when needed, instead of continuously.

1 Claim, 1 Drawing Sheet

THERMOSTATICALLY CONTROLLED BOAT DE-ICER

BACKGROUND OF THE INVENTION

This invention relates to a control device, and in particular, to a thermostat control for a boat dock de-icer. While the invention is described with respect to its application with a boat dock de-icer, those skilled in the art will recognize the wider applicability of the inventive principals disclosed hereinafter.

Boat owners who operate their pleasure craft, for example, in lakes or rivers subject to freezing, are limited in their choices for preventing cold weather from causing damage to the boat because of low temperatures. In the past, boats have been removed from the water and placed in storage. More recently, pneumatic lifts are employed in some boat docks to hoist the boat above water, essentially using the boat dock itself as the storage shed.

A second recent option has been to leave the boat in the water but use a de-icer with it during the cold months. The de-icers essentially are electrically powered pumps which blow a air/water mixture into the boat dock around the hull of the craft. The turbulence thus created prevents water in the vicinity of the boat from freezing. Pleasure craft in which the present invention finds application often are kept at or in conjunction with second homes or weekend retreats that are not inhabited continuously. Heretofore, an owner of a de-icer who suspected that temperatures might fall below freezing was required to turn the de-icer on and leave it running continuously. The continuous operation of a de-icer increases the cost of operation and reduces the de-icers useful life.

The invention disclosed hereinafter overcomes these prior art deficiencies by providing a control for the de-icer which provides for energization of the de-icer only when the water temperature at the boat dock falls into a danger zone, and removes the source of electricity to the de-icer when the sensed temperature exceeds the predetermined limit. The unattended, intermittent operation of the de-icer reduces operating costs and increases the useful life of the de-icer.

One of the objects of this invention is to provide a temperature control circuit for a de-icer used in conjunction with a boat dock.

Another object of this invention is to provide a low cost device for operating the de-icer.

Still another object of this invention is to provide a control device for a de-icer which includes a temperature sensor and a means for controlling the set point for operating a boat de-icer.

Another object of this invention is to provide for operating a boat dock de-icer when needed.

Another object of this invention is to reduce the operating costs of a boat dock de-icer.

Still another object of this invention is extend the useful life of a boat dock de-icer.

Yet a further object of this invention is to provide a low cost, simple to construct and easily maintained control for a boat dock de-icer.

Other objects will be apparent to those skilled in the art in light of the following description and accompanying drawings.

SUMMARY OF THE INVENTION

In accordance with this invention, generally stated, a thermostat control device is provided which is interconnected between the power source for a boat dock de-icer and the de-icer itself. The thermostat control includes a switch which is operated by the control upon the sensing of a predetermined temperature condition. The thermostat control is set at a temperature about the freezing temperature of the water so that, upon sensing of the water temperature falling to that value, the de-icing unit is energized. Thus, the de-icer is energized only when the water around the boat reaches the predetermined temperature, and is de-energized when the water temperature rises above that level.

DESCRIPTION OF THE PREFERRED EMBODIMENT

Figure 1:
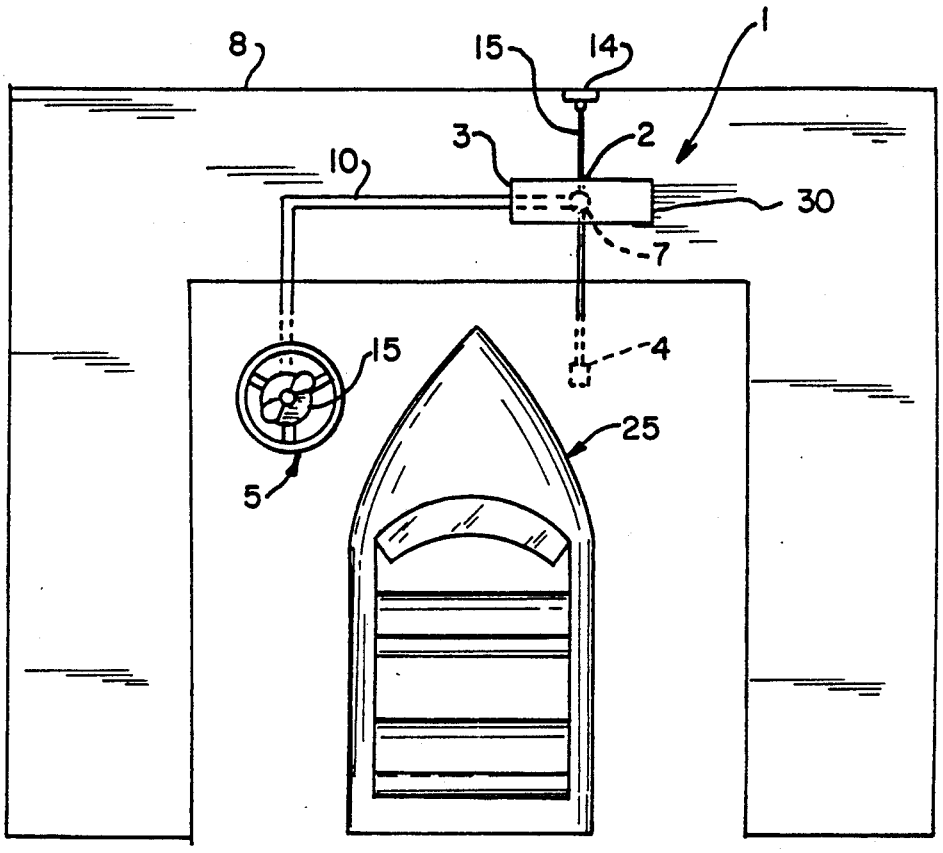
FIG. 1 is a top view illustrating use of the thermostat control of the present invention; and, FIG. 2 is a diagrammatic view of one illustrative embodiment of the thermostat control of the present invention
Figure 2:
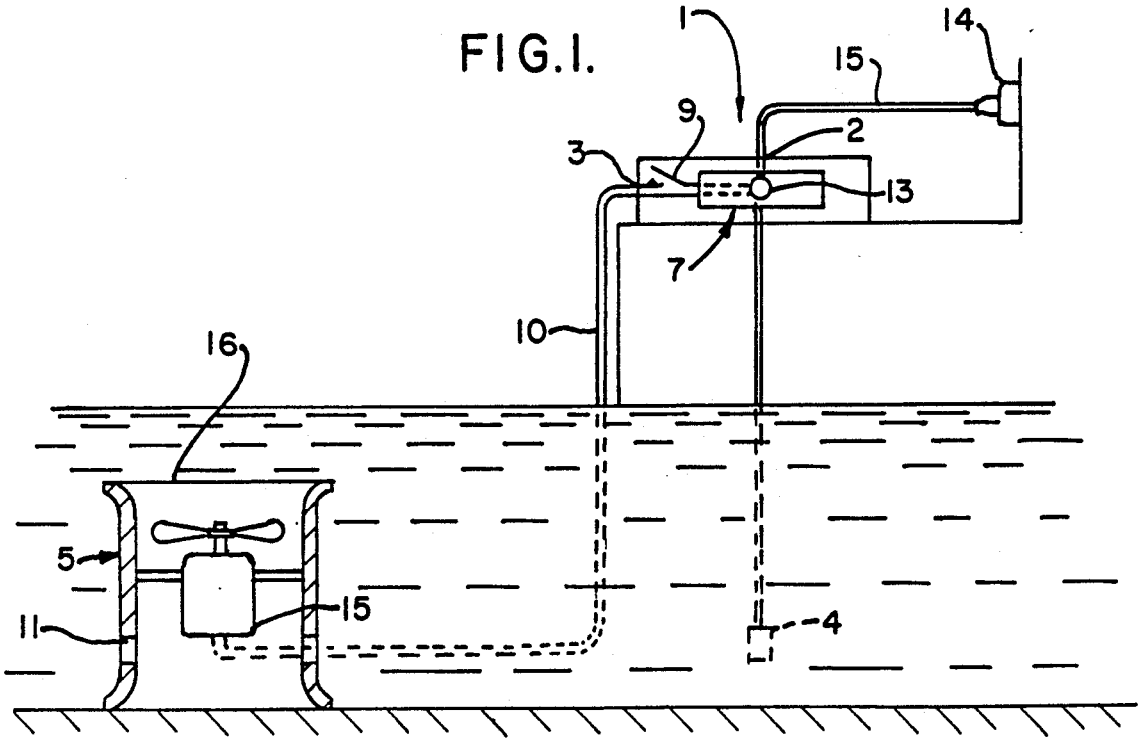

Referring now to the FIG. 1, reference numeral 1 indicates one illustrative embodiment of thermostat control of this invention. The device 1 includes an electrical outlet 3 which is electrically connected to a de-icing unit 5. Device 1 also includes an electrical inlet 2, and a sensor 4. The sensor 4 is electrically connected to a thermostat control 7 which is operatively connected to a switch 9.

The de-icing unit 5 includes an electric blower or the like 15 having an electrical cord 10. The blower forces water through an uptake 11. The de-icer forces the water through an outlet 16. The de-icer 5 is placed in a boat dock 8, as illustratively shown in FIG. 1. The mixing provided by the de-icer 5 within the boat dock 8 prevents the water around the boat dock from freezing and causing damage to a boat 25.

In use, the electrical cord 10 of the de-icer unit 5 is plugged into outlet 3 of the device 1. The device 1 includes a housing 30 having at least one of the electrical outlets or receptacles 3 associated with it. As indicated in the drawings, the de-icing unit 5 is attached to the device 1 via the cord 10 at one of the outlets 3. The housing also provides for mounting the thermostat control 7 in a convenient way. The temperature sensor 4 is inserted into the water in the boat dock or in the area to be agitated by the de-icer 5. The electrical inlet to the device is connected to a source of electrical energy 14 by an electrical cord 15.

In the preferred embodiment, the thermostat control 7 includes a set point controller 13 operatively connected to the sensor 4. The sensor 4 is then placed in the water at a convenient location. The motor of de-icer 5 is electrically connected to the control device 7 through the switch 9 and the control device is connected to the source of electrical energy. Preferably, the set point is chosen or set, at the factory for a temperature slightly around the freezing temperature, in a range, for example, between 28° (−2° C.) and 35° F. (2° C.). When the water temperature falls to that preset level, the control device 7 closes the switch 9, and permits that application of electrical energy to the de-icer 5. In its operational mode, the de-icer 5 will operate only when necessary, increasing the life span of the de-icer and reducing the costs incurred for winter storage; while at the same time properly protecting the boat.

Numerous variations within the scope of the appended claims, will be apparent to those skilled in the art in view of the foregoing description and accompanying drawings. While a single sensor is utilized with the device, those skilled in the art will recognize that multiple sensors can be used, if desired. The design of the enclosure of the control device may vary in other embodiments of the invention. Other devices that can be controlled by sensor position may be utilized in conjunction with the invention described above. These variations are merely illustrative.

Having thus described the invention, what is claimed and desired to be secured by Letters Patent is:

1. A control device for a boat de-icer which controls the application of electrical energy from a source thereof to the de-icer, comprising:

a boat de-icer including an electric motor driving a water pump and electrical connection means for connecting the motor to a source of electrical energy;

a control device interposed between said motor and the source of electrical energy, said control device including a housing having at least one electrical receptacle mounted in it, the connection means of the motor being removably electrically interconnected to said control device through said electrical receptacle a temperature sensor to be located in an outdoor body of water, and adjustment means mounted to said enclosure, said adjustment means including a thermostat connected to the temperature sensor and settable to a predetermined temperature so that said control device permits the supply of electrical energy to said motor only when the sensed water temperature drops below the temperature to which the thermostat is set and, said enclosure being a unitary device; and means for connecting or disconnecting said control device to the source of electrical energy, said last mention means including an electrical connector and plug electrically permanently connected to said enclosure.

* * * * *